United States Patent [19]

McAvoy

[11] 3,967,223

[45] June 29, 1976

[54] RESONANT RING TRANSMISSION LINE HAVING A HIGH Q MODE

[75] Inventor: Bruce R. McAvoy, Pittsburgh, Pa.

[73] Assignee: Westinghouse Electric Corporation, Pittsburgh, Pa.

[22] Filed: Feb. 18, 1975

[21] Appl. No.: 550,786

Related U.S. Application Data

[63] Continuation-in-part of Ser. No. 443,887, Feb. 19, 1974, abandoned.

[52] U.S. Cl. ..... 333/82 B; 333/84 M; 333/95 S

[51] Int. Cl.[2] ..... H01P 3/08; H01P 7/00

[58] Field of Search ..... 333/10, 82 R, 82 B, 333/84 M, 95 S

[56] References Cited

UNITED STATES PATENTS

| | | | |
|---|---|---|---|
| 3,277,403 | 10/1966 | Cohn | 333/10 X |
| 3,512,110 | 5/1970 | Clar | 333/84 M X |
| 3,681,713 | 8/1972 | Degenkolb et al. | 333/82 R |

OTHER PUBLICATIONS

Barlow et al., Surface Waves, Proc. of IEEE, 100, Pt. III, 1953, pp. 329–332.

*Primary Examiner*—Paul L. Gensler
*Attorney, Agent, or Firm*—R. M. Trepp

[57] ABSTRACT

A resonant ring transmission line capable of exhibiting a Q greater than 6000 at 4.3 gigahertz and a transmission line loss of less than 1 db per kilometer. This is accomplished by means of a resonant ring transmission line coupled to a microstrip transmission line and which resonates in the surface wave mode so that a very pure surface wave mode is created and caused to propagate along the resonant ring transmission line.

13 Claims, 4 Drawing Figures

RESONANT RING TRANSMISSION LINE HAVING A HIGH Q MODE

CROSS-REFERENCE TO RELATED APPLICATION

This application is a continuation-in-part of application Ser. No. 443,887, now abandoned, filed Feb. 19, 1974 in the name of Bruce R. McAvoy, which application is also assigned to the assignee of the present application.

BACKGROUND OF THE INVENTION

With the availability of microwave transistors and other semiconductor devices usable at microwave frequencies, the microstrip transmission line has found wide application because of its compatibility with the fabrication and installation of passive components and active devices on the same substrate with the transmission line. Essentially, a microstrip transmission line consists of a strip of conductive material, approximately corresponding to the center conductor of a coaxial transmission line, deposited on the top side of a dielectric or semiconductive substrate by photoresist techniques. The bottom side of the substrate is grounded in the area underneath the strip of conductive material on the top side and electrically corresponds to the outer cylindrical conductor of a coaxial transmission line.

Microstrip transmission lines, being open microwave structures, do not ordinarily exhibit loaded Q's much in excess of 500. Circuit losses due to dielectric dissipation, conductor resistance and leakage radiation confine Q values to approximately 1000 or less in the family of wave guide structures to which the microstrip belongs (e.g., triplate, coaxial, etc.).

There are numerous applications in microwave systems where high Q circuits and very low loss resonant ring transmission lines are highly desirable. The latter requirement arises generally with a concern for system noise and the former requirement for frequency stabilization, frequency identification, filtering, isolating, coupling, resonating and the like. Previous techniques for attaining high Q's in the neighborhood of about 1000 have involved the use of dielectric cavities of size compatible with the microstrip solid-state circuits and resonant microstrip structures of high conductivity metals (e.g., copper or gold) on the lowest loss dielectric substrate material available. Dielectric Q's are at present around 2000; and this would appear to limit the upper Q value obtainable with conventional microstrip circuit techniques.

SUMMARY OF THE INVENTION

In accordance with the present invention, a new and improved resonant ring transmission line is provided which exhibits a Q greater than 6000 at 4.3 gigahertz and an equivalent transmission line loss of less than 1 db per kilometer due to surface mode propagation. Furthermore, Q values in excess of 10,000 at X-band (i.e., 8–12 gigahertz) are possible. For this surface wave mode, neither conductor loss nor dielectric loss contribute in a conventional way as with quasi transverse electromagnetic waves to line loss; although most conventional microstrip structures will support and guide the surface wave mode.

Specifically, there is provided in accordance with the invention a resonant ring transmission line comprising a substrate of dielectric material, a resonant ring of electrically conductive material deposited on the substrate, a layer of dielectric material deposited over the resonant ring, a surface wave input means coupled to the resonant ring causing a surface wave to be created and propagated on the resonant ring having low radiative loss. That this surface wave mode can be made to resonate leads to the very high Q's attainable with the invention.

BRIEF DESCRIPTION OF THE DRAWINGS

The above and other objects and features of the invention will become apparent from the following detailed description taken in connection with the accompanying drawings which form a part of this specification, and in which.

DESCRIPTION OF THE PREFERRED EMBODIMENT

Figure 1:
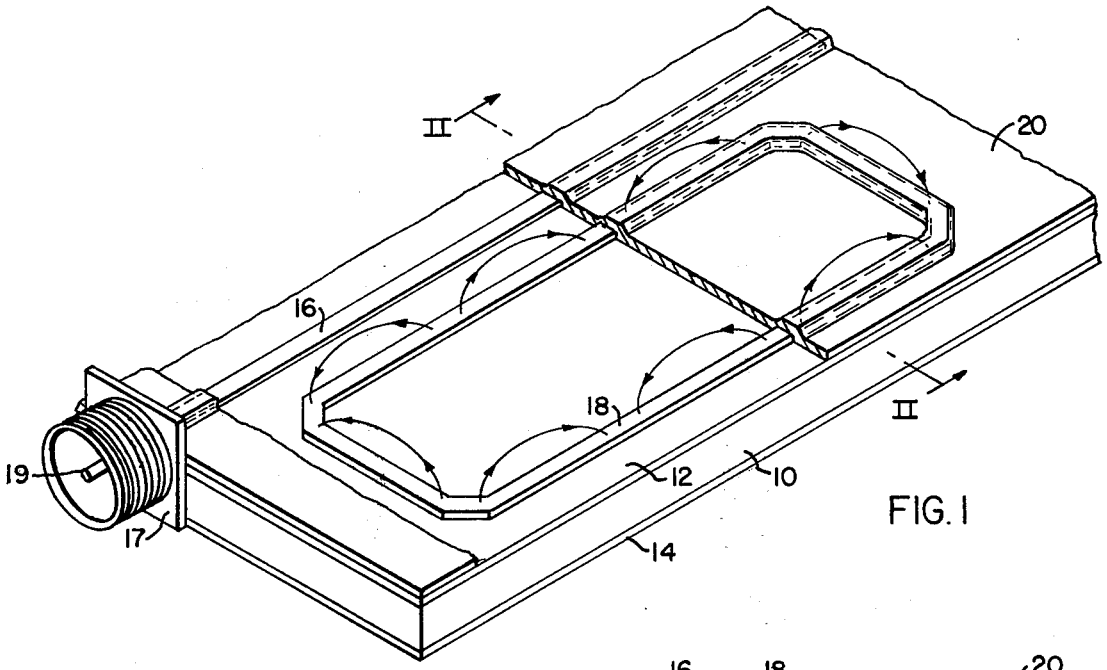
FIG. 1 is a perspective view of an embodiment of the present invention.
Figure 2:
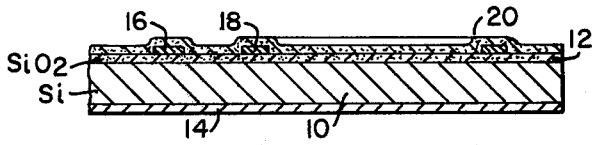
FIG. 2 is a cross-sectional view taken substantially along line II—II of FIG. 1.

With reference now to FIGS. 1 and 2, the apparatus shown includes a substrate 10 of silicon or some other similar material having a layer of silicon dioxide 12 deposited on its upper surface. The lower surface of the substrate 10 is metalized as at 14 while a microstrip transmission line 16 is deposited on the upper surface of the silicon dioxide layer 12. A coupler 17 may be employed to couple the microstrip transmission line to a coaxial transmission line, the arrangement being such that the center conductor of the transverse electromagnetic (TEM) mode transmission line is connected to the metalization 16 while the outer conductor is connected to the metalization 14.

Adjacent the metalization 16 forming the microstrip transmission line is a metalization 18 forming a resonant ring at the intersection of the sides or straight line segments with mitered corners to reduce radiation in the quasi TEM mode. The mitered corners are not considered to be straight line segments but represent the end of one straight line segment and the beginning of another. An alternate embodiment of the invention is the resonant ring of FIG. 3 without the mitered corners. The spacing between one side of the ring 18 and the transmission line 16 is such that electromagnetic energy will be coupled from one to the other and vice versa. Covering the upper surface of the oxide layer 12 as well as the metalizations 16 and 18 is a layer 20 of dielectric material, such as silicon dioxide, aluminum oxide or the like (including organic materials such as polyimide). One method of forming layer 20 of dielectric material is by applying a powdered dielectric onto the surface which may be held by a suitable means such as a bonding agent.

The microstrip transmission line 16 and the resonant ring transmission line 18 are covered with a dielectric coating 20 to a thickness several times the skin depth of the wave in the metal conductor of the microstrip. This is a minimum requirement; however, the actual thickness is unimportant as is uniformity in the thickness of the coating. Although conclusive evidence is not available, it is believed that a metal-dielectric interface is created which supports a low loss surface wave mode such as is described, for example, in an article by H. E. Barlow and A. L. Cullen entitled "Surface Waves" appearing in the *Proceedings Of IEEE*, 1953, 100, Part III, page 329 or an article by Hasagawa et al entitled "Microstrip Line on Si—$SiO_2$ System" appearing on page 869 of the *IEEE Transactions On Microwave Theory And Techniques*, November 1971. The mode of propagation, for convenience, will be referred to as a surface wave. That is, there exists, along the metal-dielectric interface, a guided surface wave which propagates without radiation. Most of the energy of the wave is constrained to flow in the immediate neighborhood of the metal-dielectric interface. A rapid or exponential decay is experienced by the field in the direction transverse to the direction of propagation (i.e., transverse to the direction of the microstrip transmission line 16). It is believed, therefore, that very little energy is absorbed by the dielectric coating and very small losses are due to the finite conductivity of the metal.

In accordance with the present invention as shown in FIG. 1, a high Q microwave resonant ring transmission line is provided by virtue of the fact that the resonant ring 18 is a surface wave type. The resonant ring 18 may, for example, be made of screened gold and resonates in a quasi transverse electromagnetic mode. It also resonates in a surface wave mode as shown by the arrows. That this surface wave mode can be made to resonate results in very high Q's.

Figure 3:
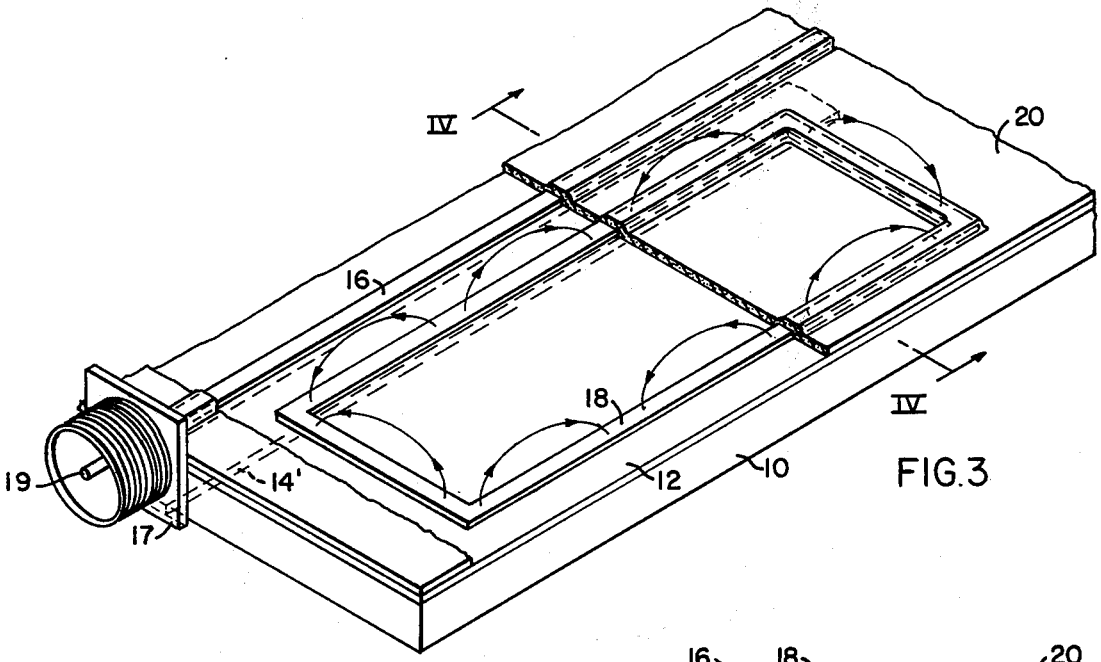
FIG. 3 is a perspective view of an alternative embodiment of the invention; and, FIG. 4 is a cross-sectional view taken substantially along line III—III of FIG. 3.
Figure 4:
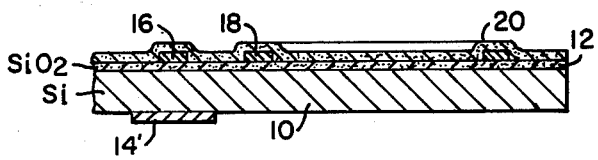

FIG. 3 shows an alternate embodiment of the invention with the resonant ring 18 without mitered corners formed by a strip of electrically conductive material deposited on the top surface of the substrate 10 which does not have conductive material in the area underneath on the bottom surface of the substrate 10 as shown in FIGS. 3 and 4. The resonant ring transmission line 18 and the microstrip transmission line 16 are covered with a dielectric coating 20 as previously described. The single strip of conductive material forming the resonant ring transmission line 18 will create and propagate surface waves but will not propagate quasi transverse electromagnetic waves.

Three conditions must be met, however, to accomplish a high Q transmission line. First, there must be coupling from the microstrip mode to the surface mode. Secondly, proper dielectric-metal boundary conditions must be established for surface mode propagation in the ring 18. Thirdly, resonance of the surface wave must be achieved without radiation. Tight coupling of the normal microstrip mode of the microstrip transmission line 16 to the resonant ring 18 is achieved by insuring that at least one E field maxima in the standing surface mode is tightly coupled to the microstrip wave propagating in the normal mode. The surface mode will propagate as described in the ring 18 if the magnitude of the reactive part of the surface impedance is sufficiently large. The surface impedance is the ratio of E over H at the dielectric-metal boundary. In the present case, this restricts the dielectric constant to values greater than 2. An upper limit on the dielectric constant is not necessary and could include semiconductors and magnetic media.

It is known that surface waves will radiate if the path of propagation is other than a straight line, however, the rectangular ring 18 as shown in FIGS. 1 and 3 will resonate without material radiative loss. The reason for this is that there is an anti-node at each corner of the ring or bend in the line. As shown by the arrows of FIGS. 1 and 3, eight anti-nodes (E field nulls) are shown on the ring or self-connected conductive path. The distribution of anti-nodes on the ring at resonance is such that there is an anti-node at each corner or bend in the straight line of the ring and therefore, the surface wave does not radiate energy. The anti-node at each corner of the ring where the E field nulls is spread out a little due to the various path lengths of the surface waves as the travel along the ring having some finite width. Where the surface wave must turn, the E field of the wave is near zero in magnitude as shown. This requires, of course, that each side or straight line segment of the rectangular ring be an integral number of half wavelengths of the wave energy passing along the transmission line. In addition, the total length of the sides or straight line segments connected end-to-end to form a rectangular ring, enclosed loop or self-connected conductive path must be equal to an even number of half wavelengths of the wave energy passing along the transmission line.

The surface wave half wavelength has been found experimentally to be about 10% longer than the quasi transverse electromagnetic half wavelength at 4.3 gigahertz in transmission line structures. The change in half wavelength is due to the shift in configuration of the electric field in the dielectric materials. For surface waves the electric field is concentrated in the dielectric at the dielectric-metal boundary. The effective dielectric constant for surface waves is normally less than the effective dielectric constant for Quasi TEM waves because the dielectric constant of the dielectric material on the top layer 20 is less than the dielectric constant of the substrate 10 and oxide layer 12. The electric field of a Quasi TEM wave is primarily in the substrate 10 and oxide layer 12 rather than in the top layer 20. Such a teaching on the effective dielectric constant and the corresponding wavelengths for Quasi TEM waves and surface waves in transmission line structures is found in "Microwave Engineering", A. F. Harvey, Academic Press, 1963, pages 445–451 and 457–465 inclusive.

Although the invention has been shown in connection with a certain specific embodiment, it will be readily apparent to those skilled in the art that various changes in form and arrangement of parts may be made to suit requirements without departing from the spirit and scope of the invention.

What is claimed is:

1. A microstrip resonant ring transmission line comprising, a substrate of dielectric material, a microstrip transmission line of electrically conductive material deposited on said substrate, a resonant ring transmission line of microstrip electrically conductive material deposited on said substrate and coupled to said transmission line and a layer of dielectric material covering said microstrip transmission line and said resonant ring transmission line causing a surface wave to be created and propagated on said resonant ring transmission line.

2. The microstrip resonant ring transmission line of claim 1 wherein the dielectric constant of said layer of dielectric material is greater than 2.

3. The microstrip resonant ring transmission line of claim 1 wherein said ring is comprised of serially connected straight line segments and adjusted in length such that the anti-nodes of the surface wave will occur at the intersection of the straight line segments. CV

4. The microstrip resonant ring transmission line of claim 3 wherein the total length of the straight line segments is equal to an even number of half wavelengths of the wave energy being carried on the transmission line.

5. The microstrip resonant ring transmission line of claim 3 wherein said ring has mitered corners located at the intersection of the straight line segments.

6. A resonant ring transmission line comprising, a substrate of dielectric material, a microstrip transmission line of electrically conductive material deposited on said substrate, a resonant ring transmission line of a strip of electrically conductive material deposited on one side of said substrate and coupled to said microstrip transmission line and a layer of dielectric material covering the microstrip transmission line and said resonant ring causing a surface wave to be created and propagated on the said resonant ring transmission line.

7. The resonant ring transmission line of claim 6 wherein the dielectric constant of said layer of dielectric material is greater than 2.

8. The resonant ring transmission line of claim 6 wherein said resonant ring transmission line is comprised of serially connected straight line segments and adjusted in length such that the anti-nodes of the surface wave will occur at the intersection of the straight line segments.

9. The resonant ring transmission line of claim 8 wherein the total length of the straight line segments is equal to an even number of half wavelengths of the wave energy being carried on the transmission line.

10. A surface wave resonant ring transmission line comprising:

a substrate of dielectric material, a resonant ring of electrically conductive material deposited on said substrate, a layer of dielectric material deposited on and covering said resonant ring, and means for coupling the E field of an electromagnetic wave to said ring causing a surface wave to be created and propagated on said ring.

11. The resonant ring transmission line of claim 10 wherein said ring is comprised of a plurality of straight line segments, connected end-to-end to form a self-connected conductive path and adjusted in length such that the anti-nodes of the surface wave will occur at the intersection of said straight line segments.

12. The resonant ring transmission line of claim 11 wherein each said straight line segment has a length equal to an integral number of half wavelengths of a predetermined resonant frequency.

13. The resonant ring transmission line of claim 11 wherein said self-connected conductive path has a total length equal to an even number of half wavelengths of said resonant frequency.

* * * * *